US009366091B2

(12) United States Patent
Garder

(10) Patent No.: US 9,366,091 B2
(45) Date of Patent: Jun. 14, 2016

(54) DECOMMISSIONING OFFSHORE OIL AND GAS WELLS

(71) Applicant: CONOCOPHILLIPS COMPANY, Houston, TX (US)

(72) Inventor: Jean Garder, Tananger (NO)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 14/709,675

(22) Filed: May 12, 2015

(65) Prior Publication Data

US 2015/0330048 A1 Nov. 19, 2015

Related U.S. Application Data

(60) Provisional application No. 62/000,345, filed on May 19, 2014.

(51) Int. Cl.

| | |
|---|---|
| ***E02B 17/00*** | (2006.01) |
| ***E02B 17/08*** | (2006.01) |
| ***E21B 15/02*** | (2006.01) |
| ***E21B 19/00*** | (2006.01) |
| ***E21B 19/16*** | (2006.01) |
| ***B63B 35/44*** | (2006.01) |
| ***E21B 29/00*** | (2006.01) |
| ***E21B 15/00*** | (2006.01) |

(52) U.S. Cl.

CPC ..... *E21B 15/02* (2013.01); *B63B 35/44* (2013.01); *E02B 17/00* (2013.01); *E02B 17/0034* (2013.01); *E21B 15/003* (2013.01); *E21B 19/002* (2013.01); *E21B 19/16* (2013.01); *E21B 29/00* (2013.01); *E02B 2017/0052* (2013.01); *E02B 2017/0095* (2013.01)

(58) Field of Classification Search

CPC ..... E02B 17/00; E02B 17/0034; E02B 2017/0052

See application file for complete search history.

(56) References Cited

U.S. PATENT DOCUMENTS

| | | | | |
|---|---|---|---|---|
| 5,360,292 | A * | 11/1994 | Allen | E02B 3/023 175/67 |
| 6,047,781 | A | 4/2000 | Scott et al. | |
| 6,729,804 | B1 * | 5/2004 | Roodenburg | B63B 35/44 175/5 |
| 6,926,097 | B1 * | 8/2005 | Blake | E02B 17/021 166/343 |
| 7,083,004 | B2 * | 8/2006 | Roodenburg | E02B 17/021 166/366 |
| 8,911,179 | B2 | 12/2014 | Noble et al. | |
| 2004/0151549 | A1 * | 8/2004 | Roodenburg | E02B 17/021 405/201 |
| 2008/0131209 | A1 * | 6/2008 | Thomas | B63B 35/003 405/198 |

(Continued)

FOREIGN PATENT DOCUMENTS

| | | | | |
|---|---|---|---|---|
| WO | WO 2004035985 | A1 * | 4/2004 | E02B 17/021 |
| WO | WO 2012144952 | A1 * | 10/2012 | B63B 35/44 |

*Primary Examiner* — Frederick L Lagman

(74) *Attorney, Agent, or Firm* — ConocoPhillips Company

(57) ABSTRACT

Method and structures perform decommissioning of offshore oil and gas platforms with associated wells. By installing on a platform (1) a movable decommissioning rig tower (2) but stripping away most of the other structures and equipment on the platform (1), and specifically not providing supporting resources such as drilling mud and power, accommodation, etc. on the platform, it is possible for both the rig tower (2) and a further rig tower (28) installed on a jack up rig (20) located alongside the platform (1) to access the well bay (5) of the platform. Thereby, two wells may be accessed simultaneously through the same well bay (5) and respective decommissioning operations carried out simultaneously and independently.

12 Claims, 1 Drawing Sheet

(56) References Cited

U.S. PATENT DOCUMENTS

2010/0221069 A1* 9/2010 Brinkmann ..... E02B 17/0021
405/203

2012/0321393 A1* 12/2012 Wilkinson, Jr. ..... E01D 15/24
405/196

* cited by examiner

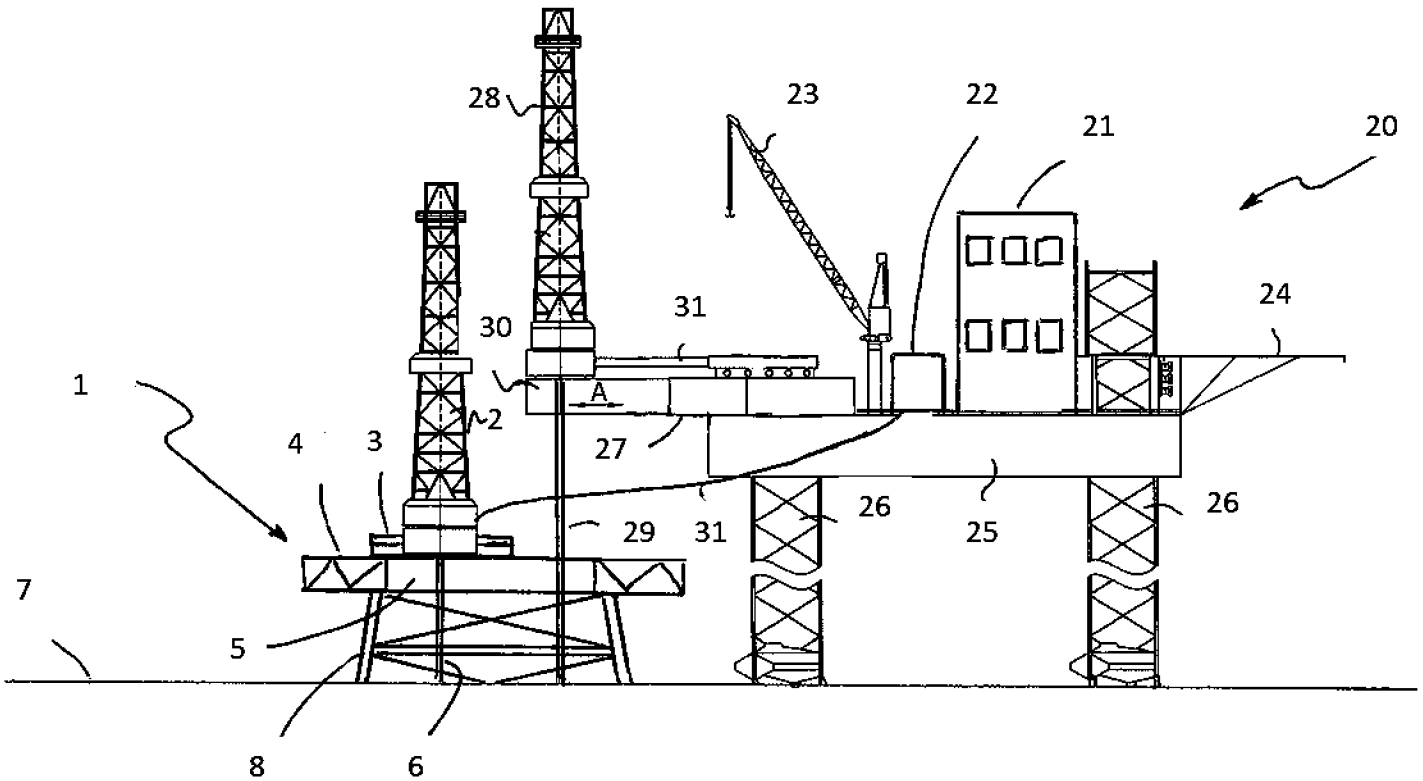
20
24
26
21
22
25
26
23
31
31
29
27
A
28
30
2
3
4
1
5
6
8
7

DECOMMISSIONING OFFSHORE OIL AND GAS WELLS

CROSS-REFERENCE TO RELATED APPLICATIONS

This application is a non-provisional application which claims benefit under 35 USC §119(e) to U.S. Provisional Application Ser. No. 62/000,345 filed May 19, 2014, entitled "DECOMMISSIONING OFFSHORE OIL AND GAS WELLS," which is incorporated herein in its entirety.

FIELD OF THE INVENTION

This invention relates to the decommissioning of offshore oil and gas wells, involving, e.g., time consuming plug and abandon operations, using heavy milling equipment, in a large number of wells normally accessed from the well bay of an offshore platform.

BACKGROUND OF THE INVENTION

After the end of their useful life, offshore oil and gas wells need to be safely taken out of service and plugged permanently. In a group of wells associated with a given offshore platform, some may come to the end of their economic life and may be plugged, perhaps with a temporary plug. There will come a time, though, where an entire platform and its associated wells must be taken out of service. This is a long and costly exercise, with the permanent plugging of each well taking on average about 50-60 rig days. There may be as many as 40 wells in a single well bay of an offshore platform.

In order to decommission a platform, it is normally necessary to provide a large rig tower capable of handling the heavy equipment e.g. for milling well casing, along with many other installations and facilities to support the operation of the rig tower and associated equipment. These installations and facilities would normally include at least power, a supply of drilling mud and accommodation for the personnel involved in the decommissioning operation.

The rig and associated installations may be accommodated on a large decommissioning jack up rig. Typically, the rig tower itself would be located on a cantilever structure extending beyond the side of the jack up itself. The jack up would be positioned alongside the platform to be decommissioned, with the cantilever structure extending above and across the platform, so that the rig tower is positioned above the well bay of the platform. Prior to this, any production rig tower on the platform would have been removed in a separate operation. Once the decommissioning rig tower is in place over the well bay, the tower may be moved on the cantilever structure to bring it into line with a specific well to be plugged. The cantilever structure may alternatively be movable on the jack up, or X-Y movement of the tower may be achieved by a combination of movement of the cantilever and tower. Once one well is dealt with, the tower is moved into position over another well, and so on.

An alternative approach is to locate a modular decommissioning rig structure on the platform to be decommissioned. This involves considerable stripping away of equipment on the platform, and adaptation of the platform to receive the large modular rig structure. The modular rig will normally include all the facilities required to run the large rig tower and heavy equipment necessary for plugging wells, as with the jack up: power, mud supply, accommodation, etc. This means the modular rig is very large and will typically occupy all or most of the surface of the existing platform, or at least cover the entire well bay. As with the jack up, the modular rig or the rig tower of the modular rig are movable in X and Y directions to allow the tower to be positioned sequentially over each well in the well bay.

BRIEF SUMMARY OF THE DISCLOSURE

The invention addresses the goal of making the decommissioning operation more efficient. Rig time for a jack up or modular rig is very expensive at several hundred thousand dollars per day, and decommissioning a platform with e.g. 40 wells where each job takes 50-60 days is clearly a very time consuming process, taking a number of years to finish. Even a small percentage saving in this time represents a very large saving in cost.

In one embodiment, the invention more particularly includes a method for decommissioning an offshore oil or gas platform, comprising the steps of: (a) providing a jack up rig, the jack up rig being equipped with one or more of an accommodation block, drilling mud supply, electrical power supply wherein the jack up rig has a cantilever structure extending over a side of the jack up rig, on which structure is mounted a decommissioning rig tower; (b) maneuvering the jack up rig alongside said platform such that the cantilever and tower overlie (extend across and above) a well within a well bay of the platform; (c) installing on the platform a second decommissioning rig tower overlying a well in the well bay of the platform; and (d) operating the first and second decommissioning rig towers and associated equipment with one or more of power, drilling mud and operator personnel from or housed on the jack up rig. The order of steps (b) and (c) may of course be reversed.

The first and/or second rig towers may be capable of supporting heavy decommissioning equipment, for example for plug and abandon operations. The equipment may for example be milling equipment capable of milling a 10 meter length of, e.g. 12¼ inch well casing. This kind of heavy equipment requires a lot of resources such as mud and power. Supplying these resources to the second well tower on the platform from the jack up rig means that there may be no need for a large modular rig on the platform having the capability to supply these requirements; hence the footprint on the platform may be greatly reduced, allowing simultaneous decommissioning operations to be conducted in two wells simultaneously. This may include simultaneous heavy operations such as milling a long length (>10 m) or large diameter (e.g. 12¼ inch) well casing.

The time taken to perform any two decommissioning operations may vary considerably from e.g. a few days to as much as 120 days, the average time being 50-60 days. A great advantage of the method described above is that the first or second rig tower may be moved and a new operation commenced in a different well, whilst the other rig tower is still operating.

The method may also apply to a platform having more than one well bay: in this case either the first and/or second towers may be moved between the first and second well bays and/or a further movable decommissioning rig tower may be installed on the platform.

In another embodiment, a combination of an offshore oil or gas platform being subject to decommissioning and a jack up rig is provided, wherein the jack up rig is equipped with one or more of a drilling mud supply, power supply, and the jack up rig has a cantilever structure extending over a side of the jack up rig, on which structure is mounted a first decommissioning rig tower; wherein the jack up rig is located alongside said oil or gas platform such that the cantilever and first tower overlie a first well within a well bay of the platform; wherein the platform is equipped with a second decommissioning rig tower overlying a second well in the well bay of the platform; and wherein the second decommissioning rig tower is operable using one or more of the said drilling mud supply, power supply from the jack up rig.

In another embodiment, an oil or gas platform is provided, having installed thereon a movable decommissioning rig tower capable of supporting an operation of milling out a 10 meter length of well casing, the rig tower and associated equipment connect to a source of drilling mud, power, which is not located on said platform. The source of drilling mud, power may be located on a jack up rig or other structure adjacent the platform. One or more further movable decommissioning towers may be installed on the platform.

BRIEF DESCRIPTION OF THE DRAWINGS

A more complete understanding of the present invention and benefits thereof may be acquired by referring to the follow description taken in conjunction with the accompanying drawings in which:

FIG. 1 is a side view of a platform ready for decommissioning and a jack up rig located alongside, in accordance with the invention.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

As shown in FIG. 1, an oil and/or gas platform 1 has had most of its installations connected with production stripped off its deck 4, and in their place is installed a large decommissioning rig tower 2 capable of operating with the heavy milling machinery often required for plug and abandon operations.

The platform decommissioning rig tower 2 is mounted on skids 3 which allow it to be moved in the X-Y plane (parallel to the surface of the deck 4) across all or part of the well bay 5. A work string 6 is shown descending from the rig tower 2, through the well bay 5 and jacket 8 and into the sea 7 on its way to a well (not shown) in the seabed.

The installation of the rig tower 2 on the platform 1 will have been carried out using either a jack up or a vessel adapted for the purpose, this kind of operation being conventional in this field. In fact, the installation of the tower would be considerably easier than installation of a large modular rig, complete with mud and power supply, etc. Such a modular rig would normally occupy most of the well bay area 5 due to the total footprint of units.

Located alongside the platform 1 is a large decommissioning jack up rig 20 comprising a deck 25 and legs 26. The jack up rig 20 is equipped with a large accommodation module 21, power and mud supplies shown schematically at 22, cranes 23, helipad 24, and various other service equipment (not shown).

Extending to one side of the deck 25 of the jack up rig 20 is a cantilever structure 27 on which is mounted a large decommissioning rig tower 28. The cantilever structure 27 and tower 28 are shown in FIG. 1 extending above and across the platform 1, so that a work string 29 descending from the rig tower 28 passes through the well bay 5 of the platform 1 beneath. The work string 29 is shown passing into the sea 7 on its way to a second well (not shown) in the seabed.

The cantilever structure 27 is capable of telescoping to move its distal end 30 in the direction shown by arrow A. The tower itself may also be moved by means of hydraulic apparatus shown at 31. The combination allows the tower to be moved in both X and Y directions in a plane parallel to the jack up deck 25, so that other wells, possibly all the other wells associated with the platform 1 may be accessed by the jack up rig tower 28.

Supply lines, an exemplary one shown at 31, connect various supply services on the jack up rig 20 such as drilling mud and power to the rig tower 2 on the platform 1. The large number of crew required to operate both rig towers can be accommodated in the accommodation block 21 on the jack up rig 20, and access to and from the combined structures may be via the helipad 24 on the jack up.

It is possible that more than one rig tower may be provided on the platform, especially if the platform is of a design having more than one well bay.

In operation, once the jack up is positioned and supply lines connected, both rig towers may function simultaneously and independently in different wells, but accessing wells through the same well bay 5 in the platform 1. Some plug and abandon operations can take 100 days or more, and if one of the rig towers is involved in such an operation, then there is no need for the other rig tower to be tied up, since it can be moved between different wells performing shorter procedures. Clearly, there is a need for the movements of the two rig towers to be coordinated and, normally, not all wells will be accessible to both towers. However, all wells can be accessed at least by one tower and most at least (possibly all) can be accessed by both.

It is possible that the well towers may be of different sizes, with one of the two towers (normally the tower on the platform) not being capable of supporting all decommissioning functions. This may have the advantage that one of the towers may be smaller. However, it is preferred that both towers are capable of performing any decommissioning operation.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method for decommissioning an offshore oil or gas platform, comprising the steps of:

a) providing a jack up rig, the jack up rig being equipped with one or more of an accommodation block, drilling mud supply and power supply, wherein the jack up rig has a cantilever structure extending over a side of the jack up rig, on which structure is mounted a first decommissioning rig tower;

b) maneuvering the jack up rig alongside the platform such that the cantilever and first decommissioning rig tower overlie a first well within a well bay of the platform;

c) installing on the platform a second decommissioning rig tower overlying a second well in the well bay of the platform; and d) operating simultaneously the first and second decommissioning rig towers and associated equipment with one or more of power, drilling mud and operator personnel from or housed on the jack up rig.

2. The method according to claim 1, wherein the jack up rig and first decommissioning rig tower are capable of supporting an operation of milling out a 10 meter length of well casing.

3. The method according to claim 1, wherein the jack up rig and second decommissioning rig tower are capable of supporting an operation of milling out a 10 meter length of well casing.

4. The method according to claim 1, wherein the platform has a further well bay and the method includes the step of moving either or both of the first and second decommissioning rig towers between wells in the respective well bays.

5. The method according to claim 1 wherein the platform has a second well bay and the method includes installing on the platform a third decommissioning rig tower overlying a well in the second well bay of the platform.

6. A method for decommissioning an offshore oil or gas platform, comprising the steps of:

providing a jack up rig, the jack up rig being equipped with one or more of an accommodation block, drilling mud supply and power supply, wherein the jack up rig has a cantilever structure extending over a side of the jack up rig, on which structure is mounted a first decommissioning rig tower;

maneuvering the jack up rig alongside the platform such that the cantilever and first decommissioning rig tower overlie a first well within a well bay of the platform;

installing on the platform a second decommissioning rig tower overlying a second well in the well bay of the platform;

operating the first and second decommissioning rig towers and associated equipment with one or more of power, drilling mud and operator personnel from or housed on the jack up rig; and moving one of the first and second decommissioning rig towers to overlie a third well in the well bay and commencing a down hole operation in the third well whilst the other of the first and second decommissioning rig towers is performing a down hole operation.

7. A combination of an offshore oil or gas platform being subject to decommissioning and a jack up rig, wherein:

a) the jack up rig is equipped with one or more of a drilling mud supply and power supply, and the jack up rig has a cantilever structure extending over a side of the jack up rig, on which structure is mounted a first decommissioning rig tower;

b) the jack up rig is located alongside the oil or gas platform such that the cantilever and first tower overlie a first well within a well bay of the platform;

c) the platform is equipped with a second decommissioning rig tower overlying a second well in the well bay of the platform; and d) the second decommissioning rig tower is operable using one or more of the drilling mud supply and power supply from the jack up rig, wherein the first and/or second decommissioning rig tower is capable of being moved whilst the other of the first and second decommissioning rig towers is performing a down hole operation.

8. The combination according to claim 7, wherein the jack up rig and first decommissioning rig tower are capable of supporting the operation of milling out a 10 meter length of well casing.

9. The method according to claim 7, wherein the jack up rig and second decommissioning rig tower are capable of supporting the operation of milling out a 10 meter length of well casing.

10. The method according to claim 7, wherein the first and second decommissioning rig towers are capable of being operated simultaneously.

11. The method according to claim 7, wherein the platform has a further well bay and either or both of the first and second rig towers is capable of being moved between wells in the respective well bays.

12. The method according to claim 7 wherein the platform has a second well bay and a third decommissioning rig tower installed on the platform.

* * * * *